US009227801B2

(12) United States Patent
Miura

(10) Patent No.: US 9,227,801 B2
(45) Date of Patent: Jan. 5, 2016

(54) IMAGE READING DEVICE

(71) Applicant: Brother Kogyo Kabushiki Kaisha, Nagoya-shi, Aichi-ken (JP)

(72) Inventor: Katsuro Miura, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/496,686

(22) Filed: Sep. 25, 2014

(65) Prior Publication Data

US 2015/0091234 A1 Apr. 2, 2015

(30) Foreign Application Priority Data

Sep. 27, 2013 (JP) ..... 2013-202225

(51) Int. Cl.

| | |
|---|---|
| ***B65H 5/06*** | (2006.01) |
| ***B65H 3/06*** | (2006.01) |
| ***B65H 3/42*** | (2006.01) |
| ***B65H 5/26*** | (2006.01) |
| ***B65H 29/52*** | (2006.01) |
| ***B65H 31/02*** | (2006.01) |

(52) U.S. Cl.

CPC ..... *B65H 5/068* (2013.01); *B65H 3/0676* (2013.01); *B65H 3/42* (2013.01); *B65H 5/26* (2013.01); *B65H 29/52* (2013.01); *B65H 31/02* (2013.01); *B65H 2301/4212* (2013.01); *B65H 2301/4213* (2013.01); *B65H 2404/6111* (2013.01); *B65H 2405/1117* (2013.01); *B65H 2405/324* (2013.01); *B65H 2405/3321* (2013.01); *B65H 2601/421* (2013.01); *B65H 2601/523* (2013.01); *B65H 2801/39* (2013.01)

(58) Field of Classification Search

CPC .. B65H 3/5223; B65H 5/068; B65H 2801/06; B65H 2801/39; G03G 15/60

USPC ..... 399/367

See application file for complete search history.

(56) References Cited

U.S. PATENT DOCUMENTS

| | | | | |
|---|---|---|---|---|
| 7,913,997 | B2 * | 3/2011 | Watanabe | 271/167 |
| 8,109,498 | B2 * | 2/2012 | Akimatsu | 271/10.11 |
| 2005/0200071 | A1 * | 9/2005 | Ikeda | 271/121 |
| 2007/0264062 | A1 * | 11/2007 | Jinza et al. | 399/367 |
| 2011/0242624 | A1 | 10/2011 | Takeuchi et al. | |
| 2012/0155941 | A1 | 6/2012 | Kozaki et al. | |
| 2012/0224903 | A1 * | 9/2012 | Honma | 400/579 |

FOREIGN PATENT DOCUMENTS

| | | |
|---|---|---|
| JP | 2011-211478 A | 10/2011 |
| JP | 2012-126530 A | 7/2012 |

* cited by examiner

*Primary Examiner* — Michael McCullough
(74) *Attorney, Agent, or Firm* — Banner & Witcoff, Ltd.

(57) ABSTRACT

An image reading device includes a conveyor which conveys a sheet from an upper path to a lower path through a curved path. The conveyance section includes a feed roller which is disposed at the upper path and feeds the sheet, a separation roller which is disposed at the upper path and separates the sheet in conjunction with a separator, and a conveying roller which conveys the sheet along the curved path. The lower path includes a horizontal path extending in a substantially horizontal direction. The separator includes a flat plate portion having a flat plate shape, and the flat plate portion is disposed above the horizontal path and is arranged in a substantially horizontal direction. The separation roller is disposed above the separator.

20 Claims, 6 Drawing Sheets

IMAGE READING DEVICE

CROSS-REFERENCE TO RELATED APPLICATION

This application claims priority from Japanese Patent Application No. 2013-202225, filed on Sep. 27, 2013, the entire subject matter of which is incorporated herein by reference.

TECHNICAL FIELD

The following disclosure relates to an image reading device.

BACKGROUND

There has been known an image reading device which includes an automatic document feeder (ADF) and can convey a sheet along a conveyance path from an upper path to a lower path through a curved path.

In an image reading device, a lower path extends obliquely in an upper direction toward a downstream side in a sheet conveyance direction. On an upper side of the lower path, a separation piece and a separation roller are disposed to be in contact with each other with an upper path interposed therebetween. In the separation piece, a portion formed in a flat plate shape is inclined obliquely along the upper path, thereby extending obliquely in the upper direction toward the downstream side in the sheet conveyance direction.

That is, in this image reading device, the lower path is inclined in the upper direction toward the downstream side, and the separation piece is inclined in the upper direction toward the downstream side. That is, the lower path and the separation piece are inclined in opposite directions with respect to a horizontal plane. Further, since the separation piece is disposed on an upper side of the lower path, the downstream end side of the separation piece is farther away from the lower path than the upstream end side, and the separation roller is disposed on the upper side of the separation piece. Therefore, in this configuration, a vertical dimension of an area where the lower path, the separation piece, and the separation roller are disposed increases, which would prevent a thickness-reduction of the device.

Incidentally, if it is desired to improve a separating performance of the separation roller, it is effective to increase a diameter of the separation roller. However, in view of the above circumstances, the vicinity of the separation roller is likely to have a large dimension in a vertical direction, which would prevent an increase of the diameter of the separation roller.

SUMMARY

Accordingly, an aspect of the disclosure relates to an image reading device which may reduce a vertical dimension of an area where a lower path, a separation piece and a separation roller are disposed and may easily reduce a thickness of the device and increase a diameter of the separation roller.

In one aspect of the disclosure, an image reading device includes a conveyor which is configured to convey a sheet along a conveyance path from an upper path to a lower path through a curved path in a conveyance direction, wherein the upper path is disposed on an upper side with respect to the lower path, the lower path is disposed on a lower side with respect to the upper path, and the curved path connects the upper path and the lower path, and a first reading unit which is configured to read an image of the sheet conveyed in the lower path by the conveyor. The conveyor includes a feed roller which is disposed at the upper path and configured to feed a sheet to a downstream side in the conveyance direction, a separator, a separation roller which is disposed at the upper path and configured to separate the sheet fed from the feed roller one by one, in conjunction with the separator, a conveying roller which is disposed at the curved path and configured to convey the sheet separated by the separation roller along the curved path, and a discharging roller which is disposed at the lower path and configured to discharge the sheet conveyed through the curved path toward a discharge region positioned on a downstream side with respect to the lower path in the conveyance direction. The lower path includes a horizontal path extending in a substantially horizontal direction. The separator includes a flat plate portion having a flat plate shape, and the flat plate portion is disposed at a position which is above the horizontal path, and is arranged in a substantially horizontal direction. The separation roller is disposed at a position which is above the separator.

According to the above configuration, the lower path includes the horizontal path. Therefore, as compared to a related-art image reading device in which a portion corresponding to the horizontal path is an inclined path, a height of an area for the lower path may be reduced. Further, the separator (separation piece) disposed above the horizontal path includes the flat plate portion having the flat plate shape, and the flat plate portion is disposed in a substantially horizontal direction, and the separation roller is disposed above the separator. Therefore, as compared to a related-art image reading device in which the entire length of a component corresponding to the separator in the conveyance direction is substantially same as that of the separator, and the whole of the corresponding component is disposed so as to be inclined, a height of an area for the separation roller may be reduced. Therefore, a height of the structure of the portion from the horizontal path to the separation roller becomes smaller than that of the related-art image reading device, and thus the thickness of the device can be reduced.

In another aspect of the disclosure, an image reading device includes: a conveyor which is configured to convey a sheet along a conveyance path in a conveyance direction; and a reading unit which is configured to read an image of the sheet conveyed by the conveyor. The conveyor includes: a feed roller; a separator; a separation roller which is configured to separate a sheet fed from the feed roller one by one, in conjunction with the separator. The separator includes: a flat plate portion which has a flat plate shape and is disposed on a downstream side with respect to a predetermined position in the conveyance direction and arranged in a substantially horizontal direction; and a protruding portion which is disposed on an upstream side with respect to the flat plate portion in the conveyance direction and protruding in an upper direction with respect to the flat plate portion.

BRIEF DESCRIPTION OF THE DRAWINGS

For a more complete understanding of the present disclosure, needs satisfied thereby, and the objects, features, and advantages thereof, reference now is made to the following illustrative descriptions taken in connection with the accompanying drawings.

FIGS. 2A and 2B are views showing an internal structure of an image reading device, wherein FIG. 2A is a vertical cross-sectional view showing a state where a second cover of an ADF section is closed, and FIG. 2B is a vertical cross-sectional view showing a state where the second cover is opened;

DETAILED DESCRIPTION

Hereinafter, a sheet conveying device and an image reading device according to an illustrative embodiment will be described.

[Structure of Multi-Function Device]

Figure 1:
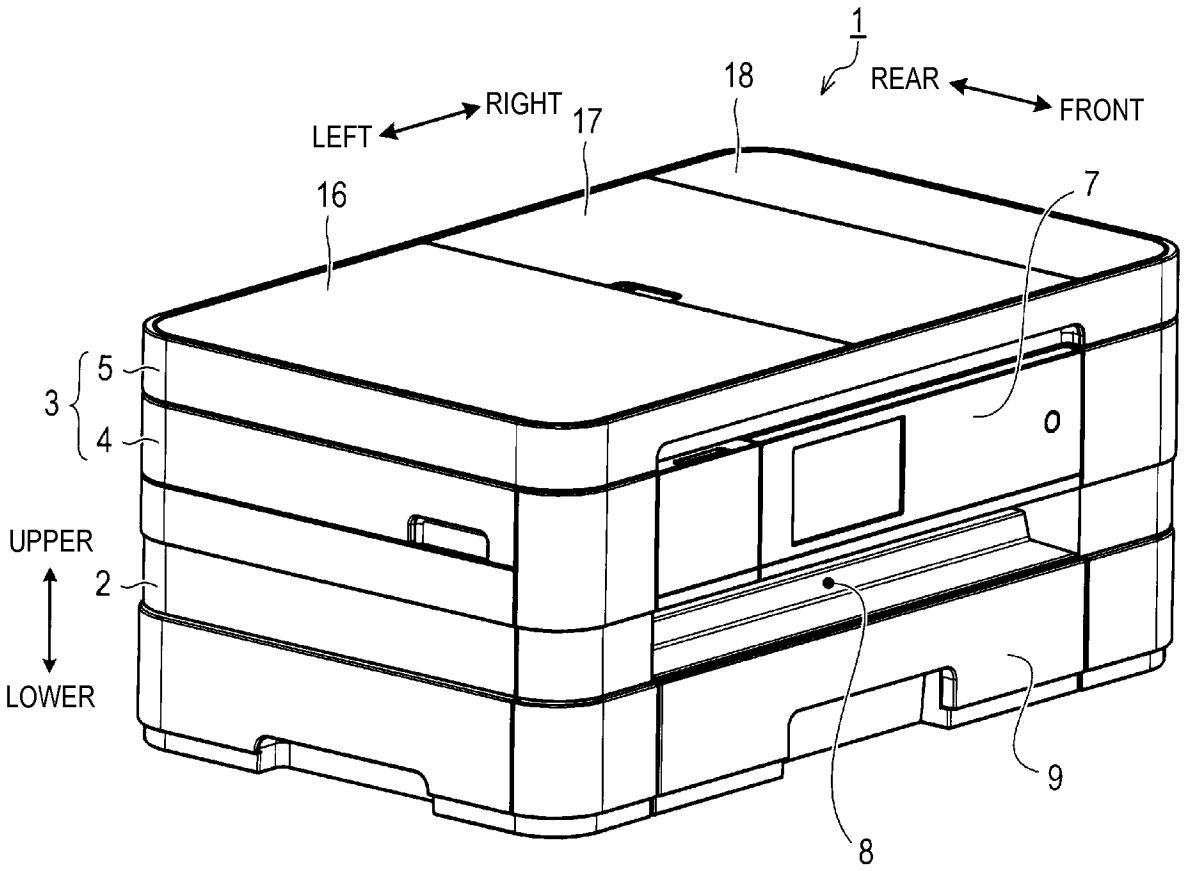
FIG. 1 is a perspective view showing a multi-function device according to an illustrative embodiment.

A multi-function device 1 shown in FIG. 1 includes a configuration corresponding to an image reading device according to an illustrative embodiment. In the following description, individual sections of the multi-function device 1 will be described with reference to directions, that is, an upper side, a lower side, a left side, a right side, a front side and a rear side shown in the drawings for simply explaining the relative positional relation among the individual sections.

The multi-function device 1 includes a main body unit 2, and a reading unit 3 which is mounted on an upper side of the main body unit 2. The reading unit 3 is attached to the main body unit 2 so as to be openable and closable. When the reading unit 3 is closed, an opening formed on an upper surface side of the main body unit 2 is closed by the reading unit 3.

The reading unit 3 includes a flat bed section (hereinafter, referred to as FB section) 4, and an ADF section 5 which is provided on an upper side of the FB section 4. The ADF section 5 is attached to the FB section 4 so as to be openable and closeable. When the ADF section 5 is closed, the ADF section functions as a cover for covering an upper surface side of the FB section 4.

The main body unit 2 includes therein a control section, an image forming section, a LAN communication section, a PSTN communication section, and the like. At an upper front portion of the main body unit 2, an operation panel 7 which can be operated by a user is provided. At a lower side of the operation panel 7, an outlet 8 for taking out recording media having been subjected to image forming in the image forming section is formed. At a lower side of the outlet 8, a medium feeding cassette 9 configured to store recording media to be fed to the image forming section is provided.

Figure 2A:
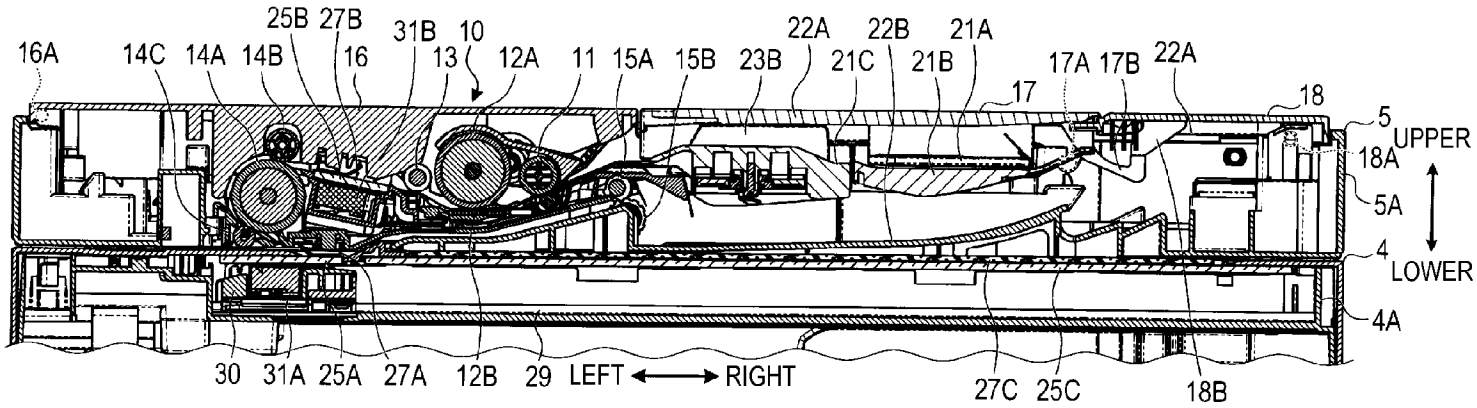
Figure 2B:
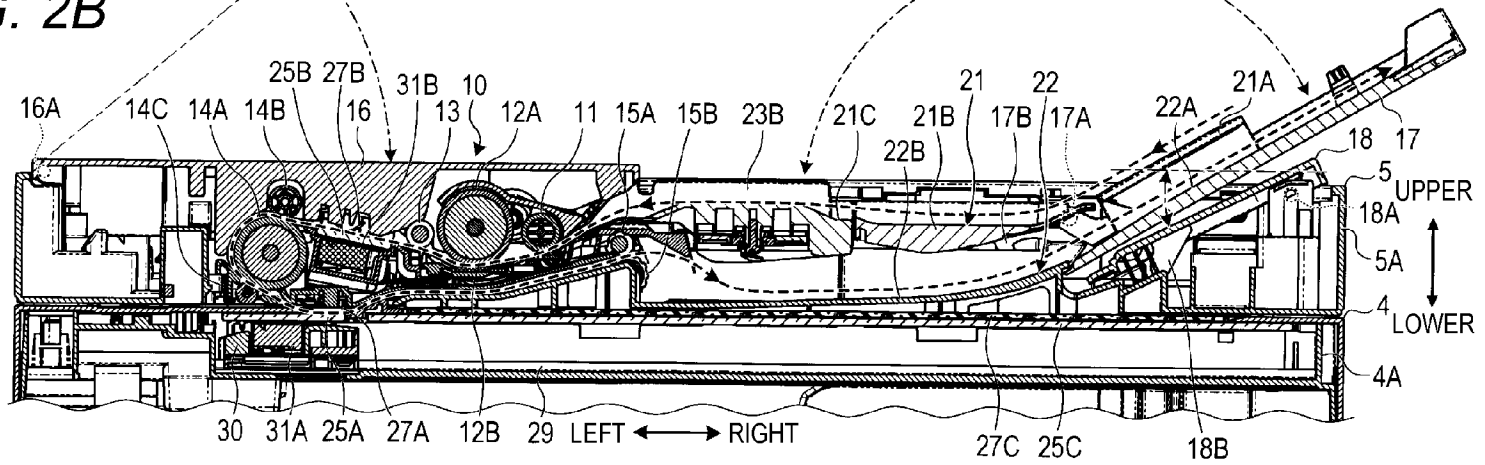

In the reading unit 3, the ADF section 5 includes a conveyor 10 configured to convey original documents along a predetermined conveyance path (see a path shown by a thick broken line in FIG. 2B) as shown in FIGS. 2A and 2B. The conveyor 10 includes a feed roller 11, a separation roller 12A, a separation piece 12B (an example of a separator), a relay roller 13, a conveying roller 14A, an upper pinch roller 14B, a lower pinch roller 14C, a discharging roller 15A, a discharge pinch roller 15B, and so on. The conveyance path is defined by these various rollers, guide surfaces positioned between adjacent rollers, and the like.

At an upper surface of the ADF section 5, a first cover 16, a second cover 17 and a third cover 18 are provided as shown in FIGS. 1, 2A, and 2B. The first cover 16 is configured to be rotatable around a rotating shaft 16A positioned in the vicinity of a left end of the first cover 16, such that a right end side of the first cover 16 rises. The second cover 17 is configured to be rotatable around a rotating shaft 17A positioned in the vicinity of a right end of the second cover 17, between a storage position shown in FIG. 2A and a use position shown in FIG. 2B. The third cover 18 is configured to be rotatable around a rotating shaft 18A positioned in the vicinity of a right end of the third cover 18, between a horizontal position shown in FIG. 2A and an inclined position shown in FIG. 2B.

When the second cover 17 and the third cover 18 are positioned at the positions shown in FIG. 2A, an arm 17B extending from the second cover 17 is engaged to an arm receiver 18B of the third cover 18. That is, while the arm 17B from the second cover 17 supports the third cover 18 from a lower side, the second cover 17 and the third cover 18 form a horizontal plane. Here, the horizontal plane which is formed by the second cover 17 and the third cover 18 is not limited to a perfectly flat plane, and may have some irregularities, or may include an inclined portion or the like. Further, from this state, if the second cover 17 is rotated from the storage position to the use position, the arm 17B is displaced toward a lower side, thereby pulling the vicinity of the left end of the third cover 18 to a lower side. As a result, in conjunction with the rotation of the second cover 17, the third cover 18 rotates from the horizontal position shown in FIG. 2A to the inclined position shown in FIG. 2B.

If the second cover 17 rotates from the storage position to the use position, the third cover 18 reaches the inclined position before the second cover 17 reaches the use position. However, thereafter, the arm 17B gets out from the arm receiver 18B, whereby the second cover 17 reaches the use position without displacing the third cover 18. Meanwhile, if the second cover 17 rotates from the use position to the storage position, first, the second cover 17 rotates without displacing the third cover 18, and before the second cover 17 reaches the storage position, the arm 17B enters the arm receiver 18B. Then, the arm 17B raises up the vicinity of the left end of the third cover 18 until the second cover 17 reaches the storage position. As a result, the third cover 18 rotates in conjunction with the second cover 17, whereby the third cover 18 reaches the horizontal position substantially at the same time as the second cover 17 reaches the storage position.

When the second cover 17 is displaced to the use position, in the ADF section 5, a first supporting section 21 configured to support an original document to be fed into the conveyor 10, from a lower side of the original document, and a second supporting section 22 configured to support an original document to be discharged from the conveyor 10, from a lower side of the original document are provided. The first supporting section 21 is provided on an upper side of the second supporting section 22, and includes a first upper support 21A, a second upper support 21B and a third upper support 21C. The second supporting section 22 is provided on a lower side of the first supporting section 21, and includes a first lower support 22A and a second lower support 22B.

Figure 3:
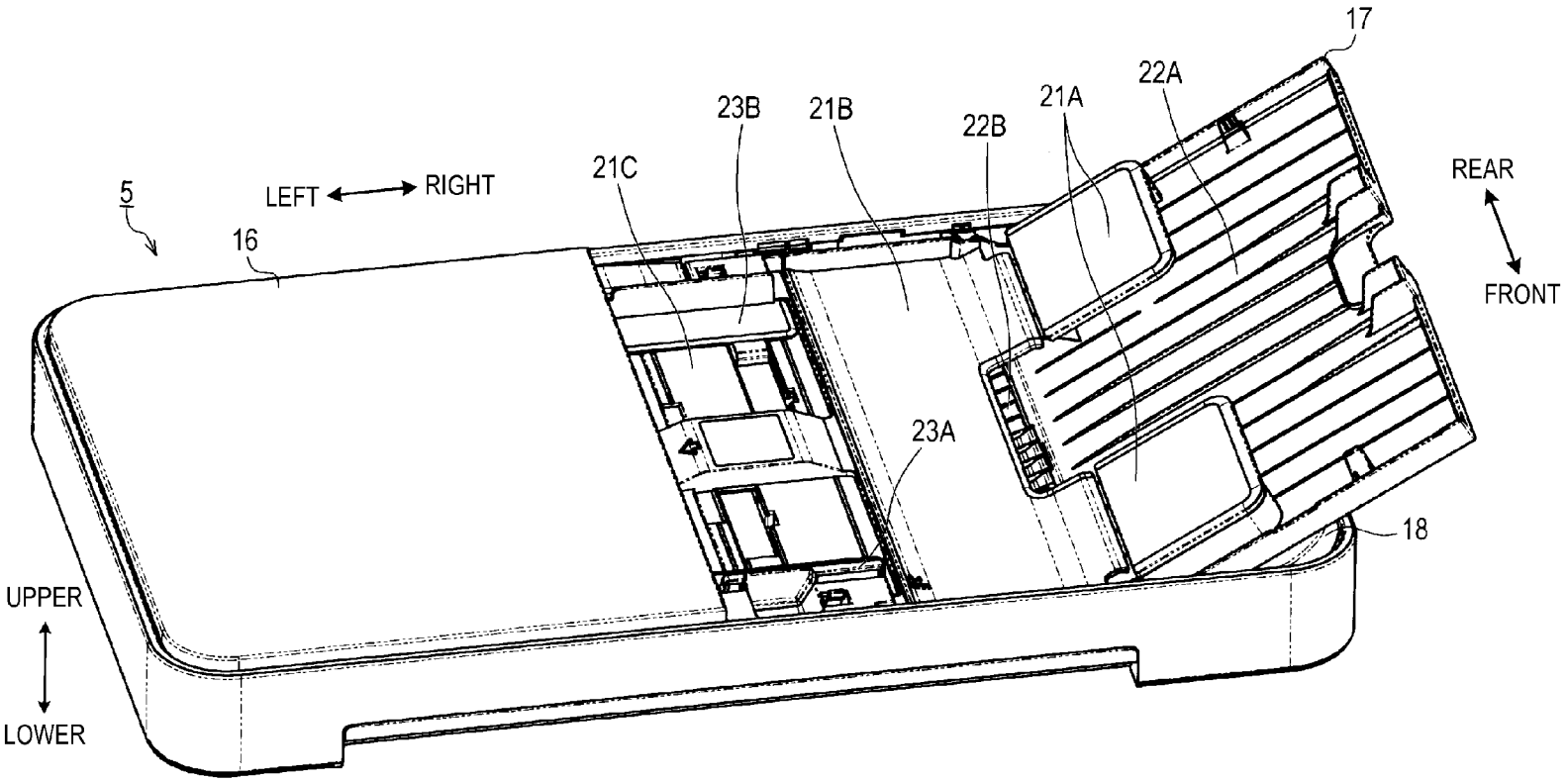
FIG. 3 is a perspective view showing the state where the second cover is opened.

The first upper support 21A is attached to the second cover 17 as shown in FIGS. 2A, 2B and 3, and rotates together with the second cover 17. The second upper support 21B is attached to a housing 5A of the ADF section 5 so as to be openable and closeable. When the second upper support 21B is opened, a portion of the second lower support 22B positioned on a lower side of the second upper support 21B is exposed. The third upper support 21C is attached to the housing 5A of the ADF section 5. The first lower support 22A is configured by one surface of the second cover 17. The second lower support 22B is configured by a bottom portion of the housing 5A of the ADF section 5.

On the third upper support 21C, guide sections 23A and 23B are provided. The guide sections 23A and 23B are brought into contact with side ends of an original document so as to regulate the conveyance direction of the original document to be sent from the first supporting section 21, to a predetermined direction.

Along the conveyance path shown by the thick broken line in FIG. 2B, an original document set on the first supporting section 21 is conveyed, and is discharged onto the second supporting section 22. At this time, the original document is sent from the first supporting section 21 toward the downstream side in the conveyance direction by the feed roller 11, and then is separated one by one by the separation roller 12A and the separation piece 12B. Thereafter, each original document is further conveyed toward the downstream side in the conveyance direction by the relay roller 13 and the conveying roller 14A, and is discharged onto the second supporting section 22 by the discharging roller 15A.

Figure 4:
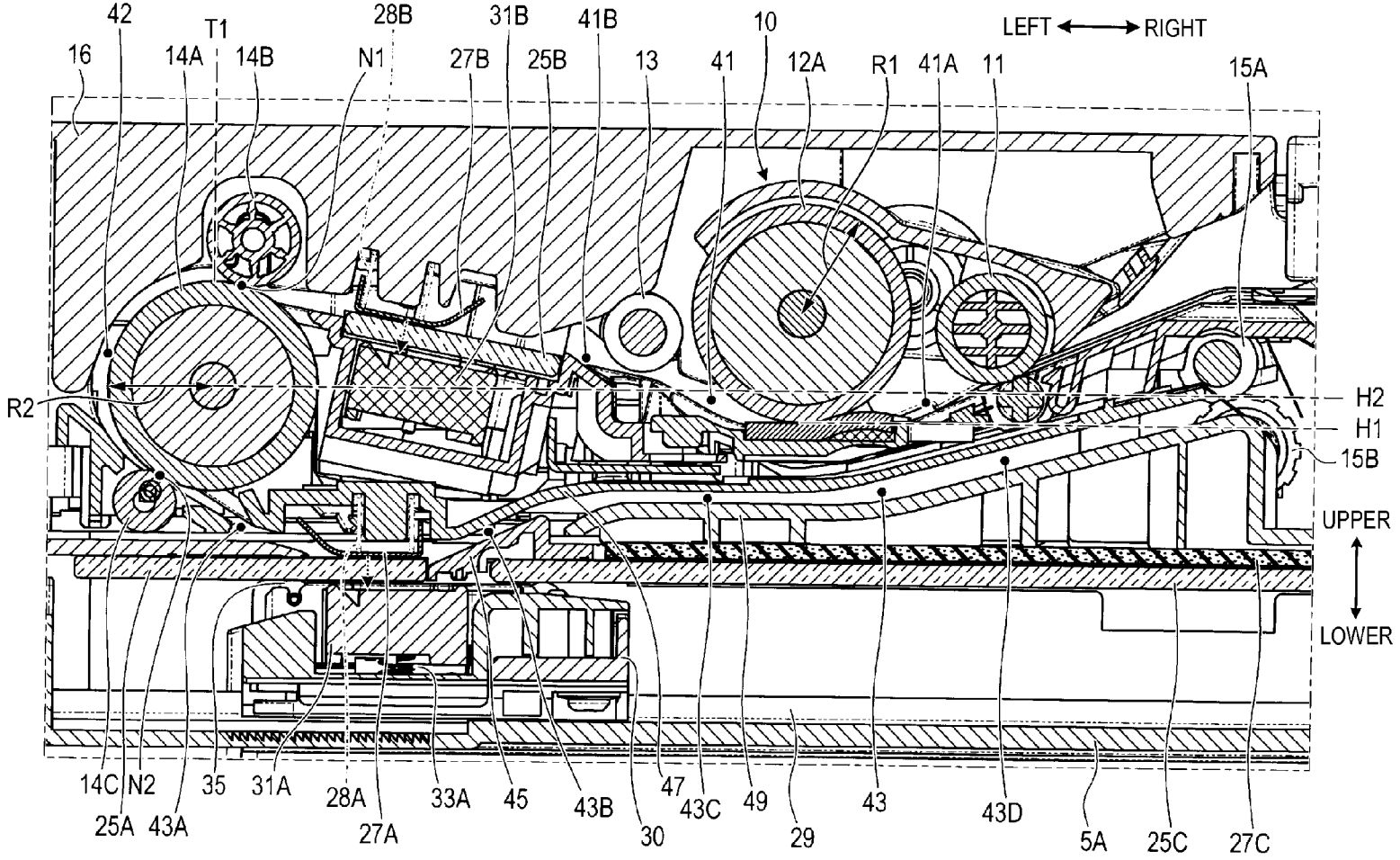
FIG. 4 is a partial enlarged view of a vertical cross section around a conveyor.

Between the conveying roller 14A and the discharging roller 15A along the conveyance path, a first transparent section 25A and a first document pressing member 27A are provided as shown in FIGS. 2A, 2B, and 4. Also, between the relay roller 13 and the conveying roller 14A along the conveyance path, a second transparent section 25B and a second document pressing member 27B are provided.

Specifically, the first transparent section 25A is provided on the FB section 4 side, and the second transparent section 25B, the first document pressing member 27A, and the second document pressing member 27B are provided on the ADF section 5 side. In this illustrative embodiment, the first transparent section 25A and the second transparent section 25B are made of glass plates, and extend over a range wider than a width of an original document in a width direction (a front-rear direction in this illustrative embodiment) perpendicular to the conveyance direction.

The first document pressing member 27A and the second document pressing member 27B are formed of a metal or a hard resin material, and extend over a range wider than the width of an original document, similarly to the first transparent section 25A and the second transparent section 25B.

As shown in FIG. 4, the first document pressing member 27A is biased toward the first transparent section 25A by a spring 28A, thereby suppressing an original document passing while being in contact with the upper surface of the first transparent section 25A from floating from the first transparent section 25A. The second document pressing member 27B is biased toward the second transparent section 25B by a spring 28B, thereby suppressing an original document passing while being in contact with the upper surface of the second transparent section 25B from floating from the second transparent section 25B.

Also, in the FB section 4, a third transparent section 25C is provided, and in the ADF section 5, a third document pressing member 27C is provided. In this illustrative embodiment, the third transparent section 25C is made of glass plates, similarly to the first transparent section 25A and the second transparent section 25B. However, the third transparent section 25C is different from the first transparent section 25A and the second transparent section 25B in that the third transparent section 25C has a sufficiently large area to which an original document to be subjected to image reading can be fit entirely.

The third document pressing member 27C is made of a laminate of a foamed resin layer and a hard resin film layer. When the ADF section 5 is closed, the third document pressing member 27C comes into close contact with the third transparent section 25C side due to a slight elastic deformation, thereby suppressing an original document placed on the third transparent section 25C from floating from the third transparent section 25C.

In the FB section 4, a guide rail 29, a carriage 30, a first image sensor 31A (an example of a first reading unit), and the like are provided. In the ADF section 5, a second image sensor 31B (an example of a second reading unit) is provided. The guide rail 29 is formed integrally with the inner surface of a bottom portion of a housing 4A of the FB section 4 and extends in a left-right direction of this illustrative embodiment in a range from a lower side of the first transparent section 25A to a lower side of the third transparent section 25C, in parallel to the lower surfaces of the first transparent section 25A and the third transparent section 25C.

The carriage 30 is mounted on the guide rail 29, thereby being supported so as to be able to reciprocate in the left-right direction along the guide rail 29. The carriage 30 is connected to a timing belt (not shown), and reciprocates in the left-right direction in conjunction with circulation of the timing belt.

In the present illustrative embodiment, as the first image sensor 31A and the second image sensor 31B, contact image sensors (CISs) are used. The first image sensor 31A is mounted on the carriage 30, and reciprocates in the left-right direction together with the carriage 30.

Between the first image sensor 31A and the second image sensor 31B, a spring 33A is interposed. The spring 33A biases the first image sensor 31A in an upper direction. Also, in the vicinities of the front and rear ends of the first image sensor 31A, spacers 35 having rollers on upper end sides are attached. The spacers 35 are biased in an upper direction together with the first image sensor 31A, thereby coming into contact with the lower surface of the third transparent section 25C or the first transparent section 25A.

Therefore, when the first image sensor 31A reciprocates together with the carriage 30, the spacers 35 moves while being in contact with the lower surface of the third transparent section 25C or the first transparent section 25A, so the first image sensor 31A moves while keeping a constant distance from the third transparent section 25C or the first transparent section 25A.

The second image sensor 31B is disposed at a predetermined position, and does not move from the predetermined position. However, the second image sensor 31B is biased toward the second transparent section 25B by a spring (not shown). Therefore, the second image sensor 31B also keeps a constant distance from the second transparent section 25B.

A plurality of reading elements of each of the first image sensor 31A and the second image sensor 31B are arranged in the front-rear direction of this illustrative embodiment. In a case of reading an image of an original document placed on the upper surface of the third transparent section 25C, the first image sensor 31A reads an image while moving together with the carriage 30.

Meanwhile, in a case of reading an image of an original document which is conveyed by the conveyor 10, the first image sensor 31A stops at a predetermined reading position located on a lower side of the first document pressing member 27A and the first transparent section 25A, and reads an image of the original document passing while being in contact with the upper surface of the first transparent section 25A. The second image sensor 31B is positioned on a lower side of the second document pressing member 27B and the second transparent section 25B, and reads an image of an original document passing while being in contact with the upper surface of the second transparent section 25B.

[Details of Conveyor]

In the conveyor 10, as shown in FIG. 4, a position H1 of a lower end of the separation roller 12A is lower than a position H2 of a rotation center of the conveying roller 14A in a height direction. A diameter R1 of the separation roller 12A and a diameter R2 of the conveying roller 14A are substantially same (if one diameter is taken as 100, the other diameter is within a range from 95 to 105).

The feed roller 11, the separation roller 12A and the conveying roller 14A are disposed so as to overlap one another as seen from a right side or a left side i.e. as seen from a direction perpendicular to the vertical direction and a direction in which an axial line of a rotation center of each roller extends. The second image sensor 31B and the conveying roller 14A are also disposed to overlap each other as seen from the right side or the left side. Further, in the present illustrative embodiment, the discharging roller 15A is also positioned to overlap the above described components. That is, in the present illustrative embodiment, all of the second image sensor 31B, the feed roller 11, the separation roller 12A, the conveying roller 14A and the discharging roller 15A are disposed so as to overlap one another as seen from the right side or the left side.

As shown in FIG. 4, the conveyance path of the conveyor 10 extends from an upper path 41 to a lower path 43 through a curved path 42. In the present illustrative embodiment, the upper path 41 refers to a path positioned on the upstream side in the conveyance direction with respect to a nip point N1 of the conveying roller 14A and the upper pinch roller 14B. The curved path 42 refers to a path positioned between the nip point N1 of the conveying roller 14A and the upper pinch roller 14B, and a nip point N2 of the conveying roller 14A and the lower pinch roller 14C. The lower path 43 refers to a path positioned on the downstream side in the conveyance direction with respect to the nip point N2 of the conveying roller 14A and the lower pinch roller 14C.

In the upper path 41, a path 41A positioned below the feed roller 11 is generally inclined in the lower direction toward the downstream side in the conveyance direction and reaches a position immediately below the separation roller 12A. Further, a path 41B from the position immediately below the separation roller 12A to the nip point N1 is generally inclined in the upper direction toward the downstream side in the conveyance direction. The second image sensor 31B is disposed below the path 41B so as to be inclined along the path 41B.

The curved path 42 is curved in an arc shape along an outer circumferential surface of the conveying roller 14A. On an inner circumferential side of the curved path 42, the single conveying roller 14A is disposed to be rotatable around a single axial line such that the outer circumferential surface of the conveying roller 14A is configured as a guide surface of the inner circumferential side of the curved path 42. The upper pinch roller 14B positioned on an inlet side of the curved path 42 is in contact with the outer circumference of the conveying roller 14A at a position which is spaced away from an upper end position T1 of the conveying roller 14A by a predetermined distance toward the upper path.

In the lower path 43, a path 43A extending from the nip point N2 to an image reading position (immediately below the first document pressing member 27A) of the first image sensor 31A is generally inclined in the lower direction toward the downstream side in the conveyance direction. Further, a path 43B extending from the first document pressing member 27A to the downstream side in the conveyance direction is generally inclined along an upper surface of an inclined guide 45, and an end of the path 43B on the downstream side in the conveyance direction is connected to a horizontal path 43C extending in a substantially horizontal direction. A path 43D on the downstream side with respect to the horizontal path 43C in the conveyance direction is generally inclined in the upper direction toward the downstream side in the conveyance direction and reaches the discharging roller 15A.

The inclined guide 45 comes into contact with an original document conveyed from the reading position in a substantially horizontal direction, from a lower side thereof, thereby guiding the original document in an obliquely upper direction. At a position above the inclined guide 45, an upper guide surface 47 is disposed so as to extend from that position toward the downstream side in the conveyance direction. A position on an opposite side to the upper guide surface 47 with respect to the lower path 43 with the lower path 43 interposed therebetween, a lower guide surface 49 is disposed. In the range from the path 43B to the path 43D, the upper side and lower side of the lower path is defined by the inclined guide 45, the upper guide surface 47 and the lower guide surface 49.

Figure 5:
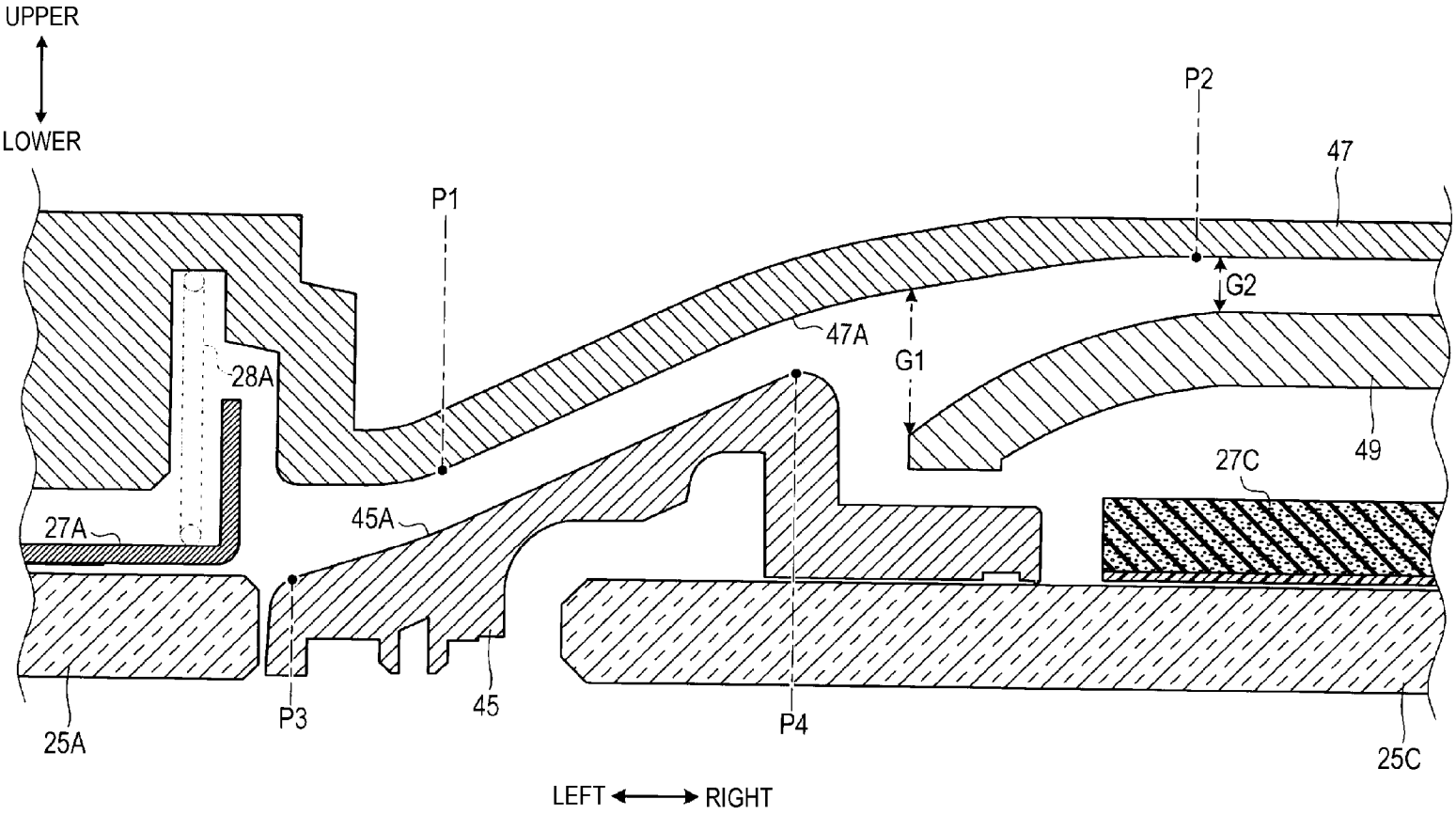
FIG. 5 is a partial enlarged view of a vertical cross section around an inclined guide.

As shown in FIG. 5, the upper guide surface 47 has a first curved surface 47A which extends over a range from a first position P1 located above the inclined guide 45 to a second position P2 located above the horizontal path 43C, such that an inclination angle of the first curved surface with respect to a horizontal plane gradually decreases toward the downstream side in the conveyance direction. If a leading end or an upper surface of an original document conveyed from the upstream side in the conveyance direction comes into contact with the first curved surface 47A, the document guide direction is gradually changed along the first curved surface 47A so as to approach a horizontal direction.

Meanwhile, the inclined guide 45 has a second curved surface 45A which extends over a range from a third position P3 to a fourth position P4 such that an inclination angle of the second curved surface with respect to a horizontal plane gradually increases toward the downstream side in the conveyance direction. If a leading end or a lower surface of an original document conveyed from the upstream side in the conveyance direction comes into contact with the second curved surface 45A, the document guide direction is gradually changed along the second curved surface 45A so as to be more inclined with respect to a horizontal direction.

The vicinity of the left end of the lower guide surface 49 has such a shape that an interval between the lower guide surface 49 and the upper guide surface 47 in the height direction becomes larger at a position closer to the inclined guide 45, and becomes smaller at a position closer to the horizontal path 43C (G1>G2 in FIG. 5). Therefore, when a leading end of an original document conveyed from the upstream side in the conveyance direction moves to the right side from the second curved surface 45A of the inclined guide 45, even if a leading end of some original document moves in the lower direction, the leading end of the original document can be received by the upper surface side of the lower guide surface 49.

Figure 6:
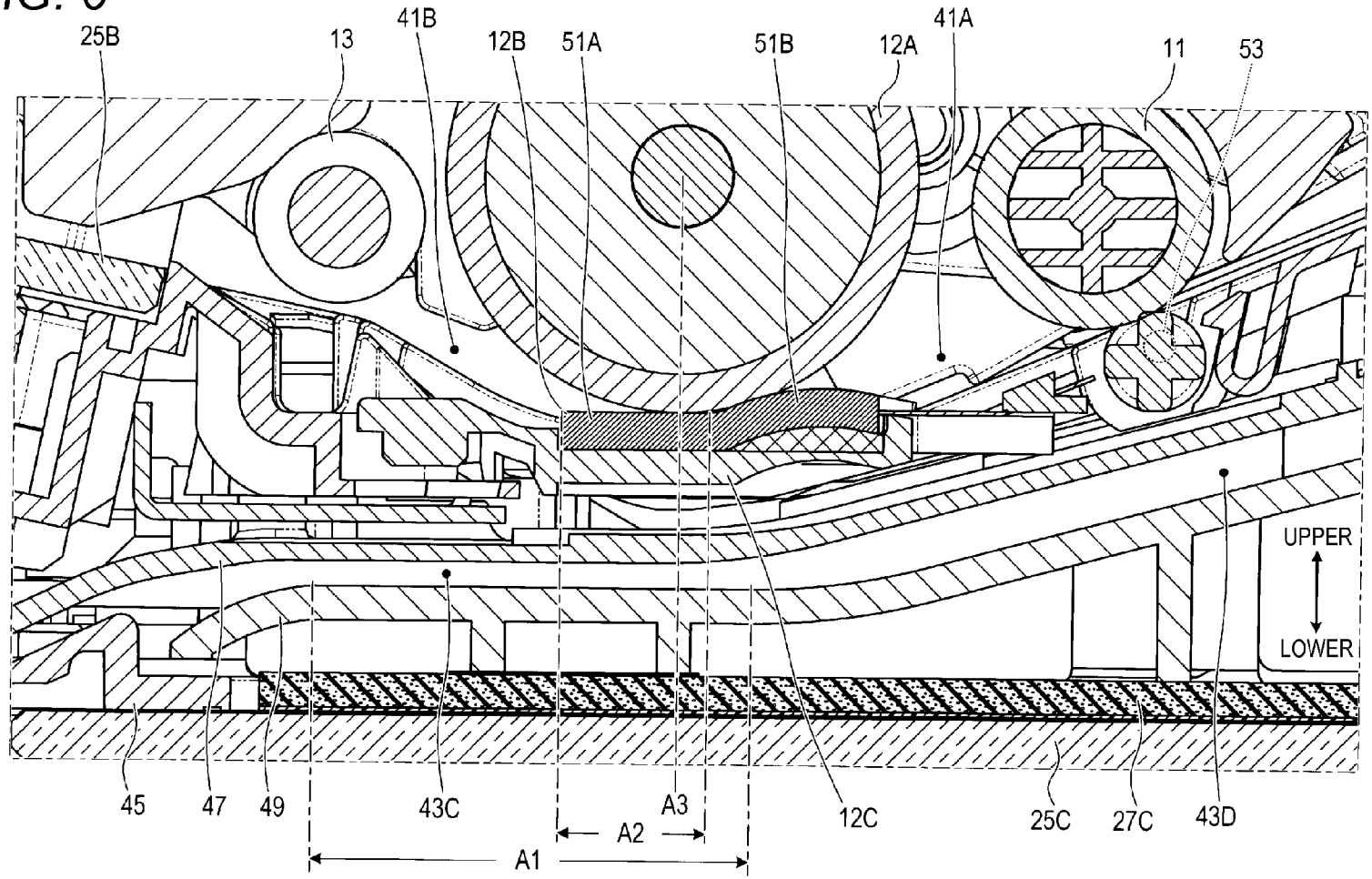
FIG. 6 is a partial enlarged view of a vertical cross section of around a separation piece.

In the above conveyance path as described above, as shown in FIG. 6, the separation piece 12B includes a portion arranged in a substantially horizontal direction at a position above the horizontal path 43C (a portion located in a range A1 shown in FIG. 6). Specifically, in the separation piece 12B, a portion MA (a portion in a range A2 shown in FIG. 6) located on the downstream side with respect to a predetermined position in the conveyance direction is formed in a flat plate shape. A portion 51B located on the upstream side in the conveyance direction with respect to the portion 51A formed in the flat plate shape has a shape protruding upward from the portion 51A formed in the flat plate shape.

The portion 51A formed in the flat plate shape is arranged in a substantially horizontal direction at a position above the horizontal path 43C. Also, the center and lower end of the separation roller 12A (at a position A3 shown in FIG. 6) is located directly above the portion 51A formed in the flat plate shape.

The separation piece 12B is held by a separation piece holder 12C. The separation piece holder 12C swings on a pivot axis 53 positioned on the lower side with respect to the feed roller 11. Therefore, the separation piece 12B is supported by the separation piece holder 12C so as to be able to swing in a direction of approaching to and separating from the separation roller 12A.

[Effects]

In the multi-function device 1, the above-described reading unit 3 has the following effects. That is, according to the above-described reading unit 3, at a portion of the lower path 43, the horizontal path 43C is disposed. Therefore, as compared to a related-art product in which a portion corresponding to the above-described horizontal path 43C is an inclined path, a height of an area for the lower path 43 may be reduced. Further, the separation piece 12B disposed above the horizontal path 43C has the portion 51A formed in the flat plate shape, and the portion 51A formed in the flat plate shape is arranged in a substantially horizontal direction, and the separation roller 12A is disposed above the separation piece 12B.

Therefore, as compared to a related-art product in which the entire length of a component corresponding to the separation piece 12B in the conveyance direction is substantially same as that of the separation piece 12B, and the whole of the corresponding component is disposed so as to be inclined, a height of an area for the separation piece 12B may be reduced. Therefore, the height of the structure of a portion from the horizontal path 43C to the separation roller 12A becomes smaller than that of the related-art product, and thus the thickness of the device may be reduced.

Further, according to the above-described reading unit 3, in the curved path 42, an original document may be turned along the outer circumferential surface of the single conveying roller 14A rotatable on the single axial line, like the letter U. Therefore, as compared to a case where a plurality of small rollers are disposed to be rotatable around a plurality of axial lines positioned on the inner circumferential side of a portion corresponding to the curved path 42, respectively, the number of components and assembling work may be reduced.

Further, according to the above-described reading unit 3, the upper pinch roller 14B is in contact with the outer circumference of the conveying roller 14A at the position on the upper path 41 spaced away from the upper end position T1 of the conveying roller 14A by the predetermined distance. Therefore, as compared to a case where the upper pinch roller 14B is in contact with the conveying roller 14A at the upper end position T1 of the conveying roller 14A, even if the outside diameter of the conveying roller 14A is substantially same as that of the upper pinch roller 14B, since the upper pinch roller 14B is disposed at a relatively lower position, a height of an area for both of the conveying roller 14A and the upper pinch roller 14B can be reduced, and thus the thickness of the device may be reduced.

Further, according to the above-described reading unit 3, the lower end position H1 of the separation roller 12A is lower than the position H2 of the rotation center of the conveying roller 14A. Therefore, as compared to a case where the lower end position of the separation roller 12A is higher than the rotation center of the conveying roller 14A, since the separation roller 12A is disposed at a relatively lower position, a height necessary to dispose the separation roller 12A and the conveying roller 14A at predetermined positions along the conveyance path may be reduced, and thus the thickness of the device may be reduced.

Further, according to the above-described reading unit 3, since the diameter of the separation roller 12A is substantially same as the diameter of the conveying roller 14A, as compared to a case of using a separation roller 12A having a smaller diameter, the separating function of the separation roller 12A may be improved. Further, although the separation roller 12A having a larger diameter can be used, as described above, the lower end position H1 of the separation roller 12A is lower than the position H2 of the rotation center of the conveying roller 14A. Therefore, the separation roller 12A is disposed at a relatively lower position, and the separation roller 12A and the conveying roller 14A may be efficiently stored in a predetermined height range. As a result, the thickness of the device may be reduced.

Further, according to the above-described reading unit 3, the upper guide surface 47 has the first curved surface 47A. Therefore, as compared to a case where there is no any component corresponding to the first curved surface 47A, an original document may be smoothly sent to the horizontal path 43C provided for reducing the thickness of the device.

Further, according to the above-described reading unit 3, the upper surface side of the inclined guide 45 has the second curved surface 45A. Therefore, as compared to a case where the inclined guide 45 does not have any portion corresponding to the second curved surface 45A, the conveyance direction of an original document conveyed from the upstream side in the conveyance direction may be more smoothly changed, thereby guiding the original document in an obliquely upper direction.

Further, in the above-described reading unit 3, the interval between the upper guide surface 47 and the lower guide surface 49 is larger at a position closer to the inclined guide 45 and is smaller at a position closer to the horizontal path 43C. Therefore, even in a case where the conveyance direction from the inclined guide 45 changes slightly upward or downward, for example, for a thick original document which is relatively firm and a thin original document which is relatively soft, each original document can be appropriately received by the portion where the interval is larger.

Further, in the above-described reading unit 3, the feed roller 11, the separation roller 12A and the conveying roller 14A are positioned so as to overlap one another as seen from a direction as described above. Therefore, as compared to a case where those rollers are positioned so as not to overlap one another, a height of an area for those rollers may be reduced, and thus the thickness of the device may be reduced.

Further, according to the above-described reading unit 3, the pivot shaft 53 of the separation piece 12B is positioned on a lower side with respect to the feed roller 11. Therefore, as compared to a case where the pivot shaft 53 is at a position closer to the separation roller 12A side than to the feed roller 11, the inclination angle of the separation piece 12B becomes less likely to vary, and the contact pressure on the separation roller 12A becomes less likely to vary. Therefore, the original document separating function can be stabilized.

Further, according to the above-described reading unit 3, in the lower path 43, the path 43D positioned on the downstream side with respect to the horizontal path 43C in the conveyance direction is inclined in an upper direction. Therefore, as compared to a case where there is no any path inclined in the upper direction as described above, the discharging roller 15A can be disposed on the upper side. Therefore, a larger space for taking original documents discharged by the discharging roller 15A may be secured on the second supporting section 22, and thus more original documents may be received on the second supporting section 22.

Further, according to the above-described reading unit 3, in the upper path 41, the path 41B positioned on the downstream side with respect to the separation roller 12A in the conveyance direction is inclined in an upper direction. Therefore, at least a portion of the curved path 42 and at least a portion of the separation roller 12A are disposed at positions overlapping each other in the height direction. Therefore, as compared to a case where a path positioned on the downstream side with respect to the separation roller 12A in the conveyance direction is not horizontal but is inclined in a lower direction, and the height of an area for the separation roller 12A and the height of an area for the curved path 42 are almost the same as those of the illustrative embodiment, a height of an area for both of the separation roller 12A and the curved path 42 can be reduced, and thus the thickness of the device may be reduced.

Further, in the above-described reading unit 3, the second image sensor 31B is disposed below the path 41B inclined in the upper direction from the separation roller 12A side toward the curved path 42 so as to be inclined along the path 41B. Therefore, although the second image sensor 31B is disposed on the inclined path, an image of an original document conveyed through the path 41B can be appropriately read.

Further, in the above-described reading unit 3, the second image sensor 31B and the conveying roller 14A are at positions overlapping each other as seen in a direction as described above. Therefore, as compared to a case where the second image sensor 31B and the conveying roller 14A are positioned so as not to overlap each other, a height of an area for the second image sensor 31B and the conveying roller 14A may be reduced, and thus the thickness of the device may be reduced.

Especially, according to the above-described reading unit 3, all of the second image sensor 31B, the feed roller 11, the separation roller 12A, the conveying roller 14A and the discharging roller 15A are positioned so as to overlap one another as seen from a direction as described above. Therefore, as compared to a case where those components are positioned so as not to overlap one another, a height of an area for those components may be largely reduced, and thus the thickness of the device may be reduced.

Also, in the separation piece 12B of the above-described reading unit 3, the portion 51B positioned on the upstream side in the conveyance direction with respect to the portion 51A formed in the flat plate shape protrudes in an upper direction with respect to the portion 51A formed in the flat plate shape. Accordingly, as compared to a case where there is no protruding portion at a position where the portion 51B should be provided so as to protrude as described above, the contact pressure between the separation piece 12B and the separation roller 12A increases. Therefore, the performance of separating original documents one by one is improved, and thus an effect of suppressing double feeding may be improved.

Other Illustrative Embodiment

Although the image reading device has been described above using the specific illustrative embodiment configured as the multi-function device 1, the present invention is not limited to the above described illustrative embodiment, and can be implemented in various forms without departing from the technical idea of the present invention.

For example, in the above-described illustrative embodiment, the reading unit 3 includes the first image sensor 31A and the second image sensor 31B. However, it is arbitrary whether the reading unit 3 includes any component corresponding to the second image sensor 31B.

Also, in the above-described illustrative embodiment, a case where the reading unit 3 is mounted to the multi-function device 1 has been described. However, the above described component may be used to configure a mono-functional image scanner device.

What is claimed is:

1. An image reading device comprising:

a conveyor which is configured to convey a sheet along a conveyance path from an upper path to a lower path through a curved path in a conveyance direction, wherein the upper path is disposed on an upper side with respect to the lower path, the lower path is disposed on a lower side with respect to the upper path, and the curved path connects the upper path and the lower path; and a first reading unit which is configured to read an image of the sheet conveyed in the lower path by the conveyor, wherein the conveyor includes:

a feed roller which is disposed at the upper path and configured to feed a sheet to a downstream side in the conveyance direction;

a separator;

a separation roller which is disposed at the upper path and configured to separate the sheet fed from the feed roller one by one, in conjunction with the separator;

a conveying roller which is disposed at the curved path and configured to convey the sheet separated by the separation roller along the curved path; and a discharging roller pair which is disposed at the lower path and configured to discharge the sheet conveyed through the curved path toward a discharge region positioned on a downstream side with respect to the lower path in the conveyance direction, the discharging roller pair comprising an upper discharging roller and a lower discharging roller, wherein the lower path includes a horizontal path extending in a substantially horizontal direction, wherein the separator includes a flat plate portion having a flat plate shape, and the flat plate portion is disposed at a position which is above the horizontal path, overlaps the horizontal path in a plan view, and is arranged in a substantially horizontal direction, wherein the separation roller is disposed at a position which is above the separator, and wherein a position of a lower end of the separation roller is disposed below an upper end of the lower discharging roller.

2. The image reading device according to claim 1, wherein the conveying roller is disposed at an inner circumferential side of the curved path and is configured as a single roller which is rotatable about a single axial line and has an outer circumferential surface configured as a guide surface of the inner circumferential side of the curved path.

3. The image reading device according to claim 2, wherein the conveyor further includes:

a pinch roller disposed at a position which is on an inlet side of the curved path and an opposite side to the conveying roller with respect to the curved path with the curved path interposed therebetween, and wherein the pinch roller is configured to contact the outer circumferential surface of the conveying roller at a position which is spaced away from an upper end position of the conveying roller by a predetermined distance toward the upper path.

4. The image reading device according to claim 2, wherein a position of a lower end of the separation roller is disposed on a lower side than a position of a rotation center of the conveying roller in a height direction.

5. The image reading device according to claim 4, wherein a diameter of the separation roller is substantially same as a diameter of the conveying roller.

6. The image reading device according to claim 1, wherein the conveyor further includes:

an inclined guide disposed at the lower path at a position which is on a downstream side with respect to a reading position of the first reading unit in the conveyance direction, and configured to guide the sheet in an obliquely upper direction, and an upper guide surface disposed at the lower path over a range from a first position located above the inclined guide to a second position located above the horizontal path, and including a first curved surface having an inclination angle with respect to a horizontal plane, which gradually decreases toward a downstream side in the conveyance direction, the first curved surface being configured to contact a sheet from an upper side thereof to gradually change a guide direction of the sheet along the first curved surface.

7. The image reading device according to claim 6, wherein the inclined guide includes a second curved surface having an inclination angle with respect to the horizontal plane, which gradually increases toward the downstream side in the conveyance direction.

8. The image reading device according to claim 7, wherein the second curved surface is configured to contact a sheet from a lower side thereof to gradually change a guide direction of the sheet along the second curved surface.

9. The image reading device according to claim 6, wherein the conveyor further includes:

a lower guide surface disposed at the lower path at a position which faces the upper guide surface on the downstream side with respect to the inclined guide in the conveyance direction, the lower guide surface defining a lower side of the lower path, and wherein an interval between the lower guide surface and the upper guide surface in a height direction is larger at a position closer to the inclined guide and is smaller at a position closer to the horizontal path.

10. The image reading device according to claim 1, wherein the feed roller, the separation roller and the conveying roller are disposed so as to overlap one another as seen from a direction perpendicular to a vertical direction and an axial direction in which an axial line of a rotation center of each of the feed roller, the separation roller and the conveying roller extends.

11. The image reading device according to claim 1, wherein the separator is supported to be swingable about an axial line in a direction of approaching to and separating from the separation roller, and wherein the axial line is positioned on a lower side with respect to the feed roller.

12. The image reading device according to claim 1, wherein a portion of the lower path on the downstream side with respect to the horizontal path in the conveyance direction is inclined in an upper direction from the horizontal path toward the discharging roller.

13. The image reading device according to claim 1, wherein the upper path includes an inclined path on a downstream side with respect to the separation roller, and the inclined path is inclined in an upper direction from the separation roller toward the curved path.

14. The image reading device according to claim 13, further comprising:

a second reading unit which is configured to read an image of a sheet conveyed by the conveyor in the upper path, wherein the second reading unit is disposed below the inclined path so as to be inclined along the inclined path.

15. The image reading device according to claim 14, wherein the second reading unit and the conveying roller are disposed so as to overlap each other as seen from a direction perpendicular to a vertical direction and an axial direction in which an axial line of a rotation center of the conveying roller extends.

16. The image reading device according to claim 15, wherein the second reading unit, the feed roller, the separation roller, the conveying roller and the discharging roller are disposed so as to overlap one another as seen from a direction perpendicular to the vertical direction and the axial direction.

17. The image reading device according to claim 1, wherein the separator includes:

the flat plate portion disposed on the downstream side with respect to a predetermined position in the conveyance direction, and a protruding portion disposed on an upstream side with respect to the flat plate portion in the conveyance direction and protruding in an upper direction with respect to the flat plate portion.

18. The image reading device according to claim 17, wherein the separation roller is disposed at a position which is above the flat plate portion of the separator.

19. An image reading device comprising:

a conveyor which is configured to convey a sheet along a conveyance path from an upper path to a lower path in a conveyance direction; and a reading unit which is configured to read an image of the sheet conveyed by the conveyor, wherein the conveyor includes:

a feed roller which is disposed at the upper path;

a separator;

a separation roller which is configured to separate a sheet fed from the feed roller one by one, in conjunction with the separator; and a discharging roller pair which is disposed at the lower path and configured to discharge the sheet conveyed toward a discharge region, the discharging roller pair comprising an upper discharging roller and a lower discharging roller wherein the separator includes:

a flat plate portion which has a flat plate shape and is disposed on a downstream side with respect to a predetermined position in the conveyance direction and arranged in a substantially horizontal direction; and a protruding portion which is disposed on an upstream side with respect to the flat plate portion in the conveyance direction and protruding in an upper direction with respect to the flat plate portion, and wherein a position of a lower end of the separation roller is disposed below an upper end of the lower discharging roller.

20. The image reading device according to claim 19, wherein the separation roller has a rotation axis disposed at a position which is above the flat plate portion of the separator.

* * * * *